US009702547B2

(12) United States Patent
Krichtafovitch et al.

(10) Patent No.: US 9,702,547 B2
(45) Date of Patent: Jul. 11, 2017

(54) CURRENT GATED ELECTRODE FOR APPLYING AN ELECTRIC FIELD TO A FLAME

(71) Applicant: ClearSign Combustion Corporation, Seattle, WA (US)

(72) Inventors: Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 167 days.

(21) Appl. No.: 14/845,681

(22) Filed: Sep. 4, 2015

(65) Prior Publication Data

US 2016/0109118 A1 Apr. 21, 2016

Related U.S. Application Data

(60) Provisional application No. 62/064,446, filed on Oct. 15, 2014.

(51) Int. Cl.
*F23D 11/32* (2006.01)
*F23C 99/00* (2006.01)

(52) U.S. Cl.
CPC ..... *F23C 99/001* (2013.01); *F23C 99/00* (2013.01); *F23D 11/32* (2013.01)

(58) Field of Classification Search
CPC ..... F23C 99/001; F23C 99/00; F23D 11/32
USPC ..... 431/2, 6, 253
See application file for complete search history.

(56) References Cited

U.S. PATENT DOCUMENTS

| | | | | |
|---|---|---|---|---|
| 2,095,065 | A | 10/1937 | Hays | |
| 2,604,936 | A | 7/1952 | Kaehni et al. | |
| 3,087,472 | A * | 4/1963 | Asakawa | F02B 51/04 123/1 R |
| 3,167,109 | A | 1/1965 | Wobig | |
| 3,749,545 | A | 7/1973 | Velkoff | |
| 4,052,139 | A | 10/1977 | Paillaud et al. | |
| 4,111,636 | A | 9/1978 | Goldberg | |
| 4,643,667 | A | 2/1987 | Fleming | |
| 4,673,349 | A | 6/1987 | Abe et al. | |
| 5,235,667 | A | 8/1993 | Canfield et al. | |
| 5,326,257 | A | 7/1994 | Taylor et al. | |
| 5,441,402 | A | 8/1995 | Reuther et al. | |

(Continued)

FOREIGN PATENT DOCUMENTS

| | | |
|---|---|---|
| EP | 0844434 | 5/1998 |
| EP | 2738460 | 6/2014 |

(Continued)

OTHER PUBLICATIONS

Arnold Schwarzenegger, A Low NOx Porous Ceramics Burner Performance Study, California Energy Commission Public Interest Energy Research Program, Dec. 2007, 5, San Diego State University Foundation.

(Continued)

*Primary Examiner* — Gregory Huson
*Assistant Examiner* — Nikhil Mashruwala
(74) *Attorney, Agent, or Firm* — Christopher A. Wiklof; Launchpad IP, Inc.

(57) ABSTRACT

A system and method for electrically controlling a position of a combustion reaction and/or for protecting a flame controller by decoupling an ionizer from a power supply.

10 Claims, 4 Drawing Sheets

(56) References Cited

U.S. PATENT DOCUMENTS

| | | | |
|---|---|---|---|
| 5,784,889 | A | 7/1998 | Joos et al. |
| 6,997,701 | B2 | 2/2006 | Volkert et al. |
| 7,137,808 | B2 | 11/2006 | Branston et al. |
| 7,243,496 | B2 | 7/2007 | Pavlik et al. |
| 7,523,603 | B2 | 4/2009 | Hagen et al. |
| 7,845,937 | B2 | 12/2010 | Hammer et al. |
| 8,851,882 | B2 | 10/2014 | Hartwick et al. |
| 8,881,535 | B2 | 11/2014 | Hartwick et al. |
| 8,911,699 | B2 | 12/2014 | Colannino et al. |
| 9,062,882 | B2 | 6/2015 | Hangauer et al. |
| 9,377,190 | B2 | 6/2016 | Karkow et al. |
| 9,388,981 | B2 | 7/2016 | Karkow et al. |
| 2005/0208442 | A1 | 9/2005 | Heiligers et al. |
| 2006/0165555 | A1 | 7/2006 | Spielman et al. |
| 2007/0020567 | A1 | 1/2007 | Branston et al. |
| 2008/0145802 | A1* | 6/2008 | Hammer ..... F23C 99/001 431/2 |
| 2010/0000404 | A1 | 1/2010 | Sakuma et al. |
| 2010/0178219 | A1 | 7/2010 | Verykios et al. |
| 2011/0203771 | A1 | 8/2011 | Goodson et al. |
| 2012/0276487 | A1 | 11/2012 | Hangauer et al. |
| 2013/0004902 | A1 | 1/2013 | Goodson et al. |
| 2013/0071794 | A1 | 3/2013 | Colannino et al. |
| 2013/0170090 | A1 | 7/2013 | Colannino et al. |
| 2013/0230810 | A1 | 9/2013 | Goodson et al. |
| 2013/0230811 | A1 | 9/2013 | Goodson et al. |
| 2013/0255482 | A1 | 10/2013 | Goodson |
| 2013/0255548 | A1 | 10/2013 | Goodson et al. |
| 2013/0255549 | A1 | 10/2013 | Sonnichsen et al. |
| 2013/0260321 | A1 | 10/2013 | Colannino et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0038113 | A1 | 2/2014 | Breidenthal et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162196 | A1 | 6/2014 | Krichtafovitch et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Krichtafovitch et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0186778 | A1 | 7/2014 | Colannino et al. |
| 2014/0196368 | A1 | 7/2014 | Wiklof |
| 2014/0196369 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0234786 | A1 | 8/2014 | Ruiz et al. |
| 2014/0234789 | A1 | 8/2014 | Ruiz et al. |
| 2014/0248566 | A1 | 9/2014 | Krichtafovitch et al. |
| 2014/0251191 | A1 | 9/2014 | Goodson et al. |
| 2014/0255855 | A1 | 9/2014 | Krichtafovitch |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta et al. |
| 2014/0295360 | A1 | 10/2014 | Wiklof |
| 2014/0335460 | A1 | 11/2014 | Wiklof et al. |
| 2014/0338350 | A1 | 11/2014 | Breidenthal |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0123576 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0175851 | A1 | 6/2016 | Goodson |

FOREIGN PATENT DOCUMENTS

| | | |
|---|---|---|
| FR | 2577304 | 12/1989 |
| GB | 1042014 | 9/1966 |
| JP | 60-216111 | 10/1985 |
| JP | 61-265404 | 11/1986 |
| JP | 2001-021110 | 1/2001 |
| WO | WO 95/00803 | 1/1995 |
| WO | WO 2012/109499 | 8/2012 |
| WO | WO 2014/005143 | 1/2014 |
| WO | WO 2014/036039 | 3/2014 |
| WO | WO 2014/099193 | 6/2014 |
| WO | WO 2014/105990 | 7/2014 |
| WO | WO 2014/127306 | 8/2014 |
| WO | WO 2014/197108 | 12/2014 |
| WO | WO 2015/012872 | 1/2015 |
| WO | WO 2015/017084 | 2/2015 |
| WO | WO 2015/017087 | 2/2015 |
| WO | WO 2015/038245 | 3/2015 |
| WO | WO 2015/042566 | 3/2015 |
| WO | WO 2015/042614 | 3/2015 |
| WO | WO 2015/042615 | 3/2015 |
| WO | WO 2015/051136 | 4/2015 |
| WO | WO 2015/051377 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |

(56) References Cited

FOREIGN PATENT DOCUMENTS

| | | |
|---|---|---|
| WO | WO 2016/007564 | 1/2016 |
| WO | WO 2016/018610 | 2/2016 |

OTHER PUBLICATIONS

Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.

F. Altendorfner et al., Electric Field Effects on Emissions and Flame Stability with Optimized Electric Field Geometry, The European Combustion Meeting ECM 2007, 2007, 1-6, Germany.

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

* cited by examiner

CURRENT GATED ELECTRODE FOR APPLYING AN ELECTRIC FIELD TO A FLAME

CROSS REFERENCE TO RELATED APPLICATIONS

The present application claims priority benefit from U.S. Provisional Patent Application No. 62/064,446, entitled "CURRENT GATED ELECTRODE FOR APPLYING AN ELECTRIC FIELD TO A FLAME", filed Oct. 15, 2014; which, to the extent not inconsistent with the disclosure herein, is incorporated by reference.

SUMMARY

According to one embodiment, a system for electrically controlling a combustion reaction includes a burner configured to generate the combustion reaction. The combustion reaction can be characterized by a resistance and a capacitance. The system may include a flame holder positioned proximate to the burner to at least partially carry the combustion reaction, the flame holder being electrically conductive or semiconductive. The system may include a flame controller operable to electrically charge the capacitance of the combustion reaction and to apply a flame holder voltage to the flame holder to attract the combustion reaction to the flame holder. The flame controller may include an electrode positioned proximate to the flame holder to enable the electrode to supply the combustion reaction with charged particles. The flame controller may also include a power supply operably coupled to the electrode to excite the electrode to generate the charged particles, and a voltage divider operably coupled to the flame holder to provide the flame holder voltage.

According to one embodiment a combustion reaction control system with protection for a power supply may include a first electrode coupled to the power supply to receive a first voltage. The first electrode may generate charged particles to charge a capacitance in a combustion reaction, in response to receipt of the first voltage. The system may include a second electrode carried by the first electrode. The second electrode may be electrically insulated from the first electrode, and the second electrode may be configured to detect proximity of the combustion reaction to the first electrode. The system may include a switch coupled to the power supply to selectively enable the power supply to provide the first voltage to the first electrode, and the switch may include a control terminal coupled to a resistive network to receive a switch voltage. The resistive network may be operably coupled to the second electrode to generate the switch voltage in response to receipt of a current or a second voltage by the second electrode. The switch voltage may be proportional to the current or the second voltage. The switch may decouple the first electrode from receipt of the first voltage, if the switch voltage exceeds a pre-determined threshold, to reduce potential short-circuit damage to the power supply when the combustion reaction contacts the first electrode.

According to one embodiment, a method for electrically controlling a combustion reaction may include applying a voltage to an ionizer to cause the ionizer to supply charged particles to a combustion reaction to charge the combustion reaction to a first potential. The method may include applying a second potential to a flame holder that is configured to at least partially carry the combustion reaction. The method may include adjusting the second potential at the flame holder to maintain the second potential within a range that attracts the combustion reaction to the flame holder.

According to one embodiment, a method for protecting an electrodynamic flame controller may include applying a first voltage to a first electrode to cause the first electrode to supply charged particles to a combustion reaction to charge the combustion reaction to a first potential. The method may include receiving a second voltage at a second electrode. The second electrode may be carried by the first electrode. The method may include generating a switch voltage based at least partially on the second voltage. The method may include selectively operating a switch to decouple the first electrode from the first voltage, if the switch voltage exceeds a threshold.

DETAILED DESCRIPTION

Figure 1:
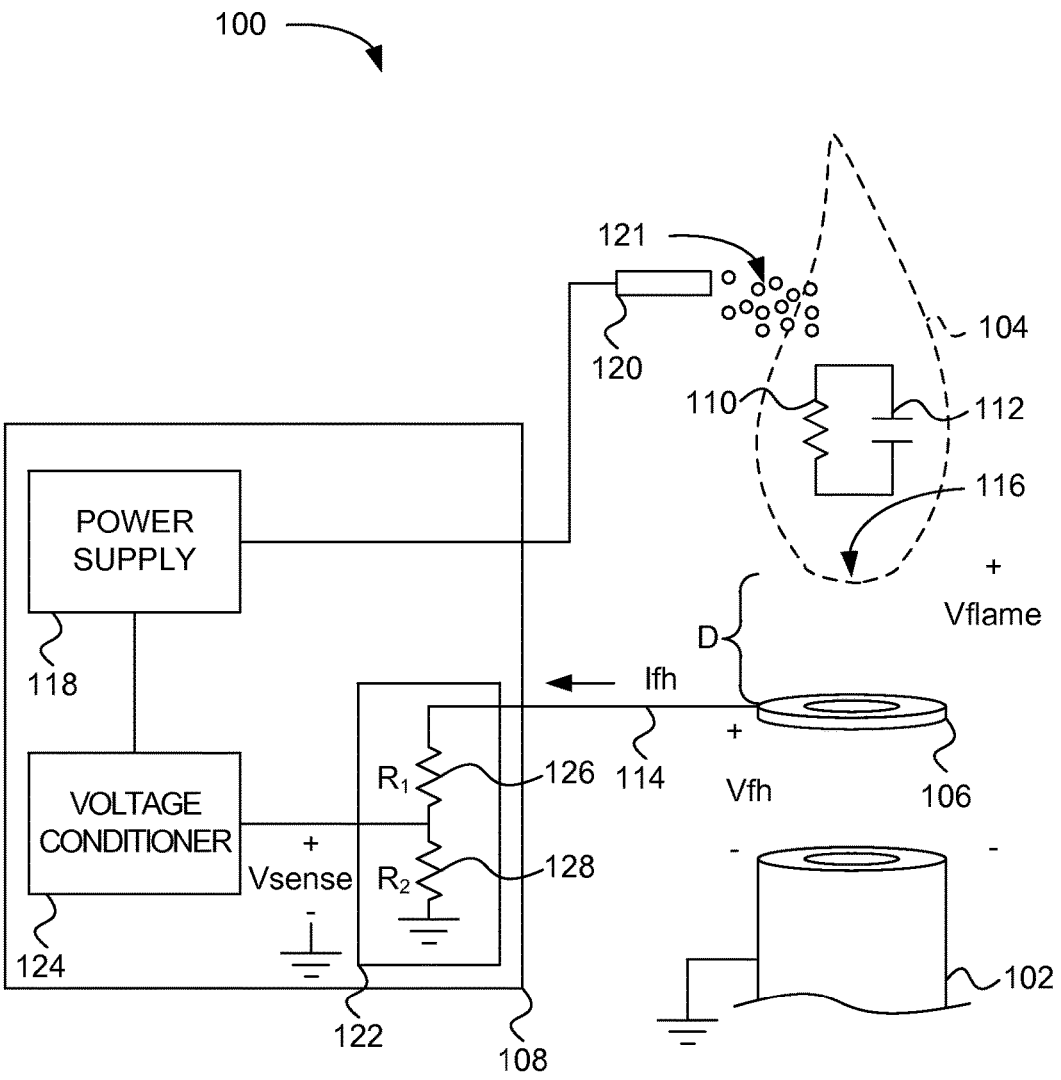
FIG. 1 is a circuit diagram of system for electrically controlling a position of a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Electrodynamic combustion reaction control may be used to control and/or vary characteristics of a combustion reaction (hereafter, "flame"). The application of a voltage, charge, current, and/or electric field to a flame may be used to improve heat distribution of the flame, to stabilize the flame, to prevent flame impingement and/or to reposition the flame. The application of electrodynamic combustion reaction control may also improve the energy efficiency, shape, and/or heat transfer of the flame.

An electrodynamic flame controller, i.e., a flame controller, may be used to correct an undesirable flame position. For example, upon ignition, a flame may be suspended a distance from a flame holder, when it may be advantageous to have the flame positioned at the flame holder. The distance between the flame and the flame holder may contribute to instability for the flame or may otherwise affect the characteristics of the flame. According to various embodiments, the electrodynamic flame controller can be configured to sense current through the flame and apply charge to the flame to position, reposition, or otherwise control the location of the flame.

The electrodynamic flame controller may be configured to protect a power supply within the controller by selectively decoupling one or more electrodes from the power supply. According to various embodiments, the electrodynamic flame controller can be configured to monitor proximity or contact between a flame and one or more flame controller electrodes. Because contact between the flame and the electrodes may cause damage to the power supply, the electrodynamic flame controller may selectively decouple the power supply from the electrodes or may selectively de-energize the power supply when contact between the flame and the electrodes is detected.

As used herein, terms that relate to relative directions such as up/down, top/bottom, etc. are used to facilitate ease of understanding. The inventors contemplate apparatuses described herein in various orientations include side-firing and down-firing. It will be understood that the relative directions refer to directions shown in the accompanying drawings, but carry meanings that are applicable to other orientations.

Depictions shown in the drawings are simplified for ease of understanding. In particular, while the flame 104 is depicted as a diffusion-limited flame shape familiar to most readers, it will be understood that embodiments are also applicable to various burner arrangements such as pre-mix, forced air, swirl stabilized, staged air, staged fuel, and etc. that may produce different and/or chaotic flame shapes; or even "flameless" combustion. All such flame variations are believed to be characterized by resistance 110 and capacitance 112, and thus are contemplated to be controllable as described herein.

FIG. 1 illustrates an electrodynamic flame control system 100 for controlling the position of a flame with respect to a flame holder, according to one embodiment. When the flame becomes physically decoupled from its flame holder, characteristics of the flame can be less desirable than when the flame is physically coupled to or in close proximity to a flame holder for the flame, according to one embodiment. For example, when the flame becomes physically decoupled from its flame holder, the flame may be less stable, and therefore more likely to make contact with surrounding structures. The electrodynamic flame control system 100 may control the position of the flame with respect to the flame holder by charging the flame, applying a potential to the flame holder, and monitoring current flow between the flame and the flame holder, according to various embodiments. The electrodynamic flame control system 100 can include a nozzle 102, a flame 104, a flame holder 106, and a flame controller 108, according to one embodiment.

The nozzle 102 may supply fuel for generating the flame 104. The nozzle 102 may supply any of a number of fuels, such as kerosene, natural gas, other petroleum-based products, hydrogen, other combustible fluids, and/or mixtures of fuels. The nozzle 102 or a ground electrode positioned near the nozzle may be coupled to ground to provide a 0 V reference point for the flame 104 and the flame holder 106, according to one embodiment.

The flame 104 includes a resistance 110 and a capacitance 112. The resistance 110 can vary based on the temperature, length, width, and/or composition of the flame 104. According to one embodiment, the resistance 110 is approximately 10 megaohms ("MΩ"). In other embodiments, the resistance 110 can be within 5-15 MΩ. The capacitance 112 can also vary based on various characteristics of the combustion reaction 104. In one embodiment, the capacitance 112 can be within 3-50 picofarads ("pF"), or more particularly between 3-5 pF. Because the flame 104 includes the capacitance 112, the flame 104 has the capacity to receive and retain charge and thereby exhibit a voltage potential with reference to other voltage potentials. According to various embodiments, the flame controller 108 charges the flame 104 to various voltages, e.g., 30-50 kV, to enhance, provide, or otherwise modify the stability, the heat, the height, the width, the color, the position, and/or other characteristics of the flame 104 within the electrodynamic flame control system 100.

The flame holder 106 can provide a platform (e.g., determine a location) for the flame 104 combustion, according to one embodiment. The flame holder 106 may be shaped as a ring, a crescent, a cross, a square, or other shape and may be a plate, a mesh, or other conductive structure through which fuel can be injected, forced, or otherwise driven to produce the flame 104. The flame holder 106 includes an opening or aperture, through which fuel may pass, to generate the flame above the flame holder 106. The flame holder 106 can be electrically coupled to the flame controller 108 with a conductor 114 to enable the flame controller 108 to charge the flame holder 106 to one or more predetermined voltage levels, according to one embodiment. Viewed another way, the flame holder 106 can be electrically coupled to the flame controller 108 with a conductor 114 to enable the flame controller 108 to control a voltage level to which the flame 104 is allowed to charge the flame holder 106.

By simply igniting fuel that is ejected from the nozzle 102, the flame 104 can be displaced by a distance D above the flame holder 106. However, while ignited at the distance D above the flame holder 106, the flame 104 can exhibit increased lateral mobility or other characteristics that may affect the performance of the electrodynamic flame control system 100. By applying a potential to the flame holder 106, a bottom 116 of the flame 104 can be attracted, drawn, physically coupled, and/or otherwise positioned onto the flame holder 106, according to various embodiments. For example, if the flame 104 is charged approximately 40 kV and the flame holder 106 is charged to a significantly less voltage, e.g., 1 kV, the difference in voltage between the flame 104 and the flame holder 106 can attract the flame 104 to the flame holder 106, e.g., through Coulomb's law.

The flame controller 108 may charge the flame 104 to a flame voltage ("$V_{flame}$") to affect the characteristics of the flame 104 and may charge the flame holder 106 to a flame holder voltage ("$V_{fh}$") to attract the flame 104 to the flame holder 106, according to one embodiment. The flame voltage $V_{flame}$ may represent the potential difference between the flame 104 and the nozzle 102 or ground electrode near the nozzle. The flame holder voltage $V_{fh}$ may represent the potential difference between the flame holder 106 and the nozzle 102. The flame controller 108 may include a power supply 118 operably coupled to an electrode 120, and a voltage divider 122 operably coupled to a voltage conditioner 124 for controlling the flame voltage $V_{flame}$ and the flame holder voltage $V_{fh}$.

The power supply 118 may charge the flame 104 to the flame voltage $V_{flame}$ by providing a voltage to the electrode 120 that causes the electrode 120 to supply charged particles to the flame 104. The power supply 118 can include one or more AC/DC voltage converters, DC/AC voltage inverters, and one or more half-wave or full-wave rectifiers to supply a DC, substantially DC, varying DC, or AC voltage to the electrode 120. According to various embodiments, the power supply 118 may be configured to constantly, periodically, intermittently, and/or selectively provide a DC voltage to the electrode 120, e.g., via step function.

The flame controller 108 can use the electrode 120 to charge the flame 104 with charged particles 121 to alter the charge and/or other characteristics of the flame 104. According to one embodiment, the electrode 120 begins transmitting the charged particles 121 to the flame 104 when the electrode 120 receives a voltage from the power supply 118 that approaches 4 kV. According to various embodiments, the charged particles 121 may have a positive polarity or a negative polarity, depending upon the polarity of the voltage received by the electrode 120 from the power supply 118, and may thus include ions and/or electrons. The electrode 120 may be configured as an ionizer. The electrode 120 may be a needle, a blade, a serrated blade, a plate, a ring, or another configuration of ionizer electrode and that is useful for generating charged particles 121 in response to excitement by a voltage. Alternatively, the electrode 120 may include a non-ion ejecting electrode configured to convey charged particles 121 to the flame 104 by direct contact with the flame.

The flame controller 108 can use the voltage divider 122 to establish and maintain the flame holder voltage $V_{fh}$ at the flame holder 106. The voltage divider 122 can receive current from the flame holder 106 through the conductor 114 and can establish, set, or maintain the flame holder voltage $V_{fh}$ through the conductor 114. The voltage divider 122 can include a first resistor ("$R_1$") 126 and a second resistor ("$R_2$") 128. The first resistor 126 can be set to be significantly larger, e.g., 20 times larger, than the second resistor 128, so that the first resistor 126 predominantly sets the flame holder voltage $V_{fh}$ and so that the second resistor 128 establishes a feedback voltage $V_{sense}$ that is proportional to the flame holder voltage $V_{fh}$. The flame holder voltage $V_{fh}$ can be represented by the flame holder current $I_{fh}$ and the resistance of the voltage divider 122, e.g., $V_{fh}=I_{fh}*(R_1+R_2)$. The relationship between the flame holder voltage $V_{fh}$ and the feedback voltage $V_{sense}$ can be represented by: $V_{sense}=V_{fh}*(R_2)/(R_1+R_2)$. Thus, the voltage divider 122 can provide the power supply 118 with a voltage that is proportional to the flame holder voltage $V_{fh}$, e.g., with the feedback voltage $V_{sense}$.

As an illustrative example, the flame controller 108 can be configured to maintain a flame holder voltage $V_{fh}$ of 1 kV to attract the flame 104 to the flame holder 106. If the flame 104 discharges a 10 milliamp (mA) flame holder current $I_{fh}$ through the conductor 114 while the flame voltage $V_{flame}$ is approximately 40 kV, then the total resistance of the first resistor 126 and the second resistor 128 can be set to be approximately 100 kΩ to generate a 1 kV flame holder voltage $V_{fh}$.

A total resistance of 100 kΩ can be achieved with a 20:1 resistance ratio in the voltage divider 122 by setting the first resistor 126 to approximately 95 kΩ and by setting the second resistor 128 to approximately 5 kΩ. If the flame holder voltage $V_{fh}$ is 1 kV, the feedback voltage $V_{sense}$ will be approximately 50 V. A voltage conditioner 124 and the power supply 118 can be configured to monitor the value of the feedback voltage $V_{sense}$ and can change the flame voltage $V_{flame}$ to achieve a particular or a predetermined flame holder voltage $V_{fh}$. For example, if $V_{sense}$ is lower than 50 V, then the power supply 118 can supply additional charged particles 121 in order to increase the flame voltage $V_{flame}$. Similarly, if $V_{sense}$ is greater than 50 V, then the power supply 118 can supply fewer charged particles 121 in order to decrease the flame voltage $V_{flame}$, according to various implementations. It is to be understood that these are example values, and implementations of the disclosed configurations are not limited to these example values.

The voltage conditioner 124 can include additional circuitry to amplify or reduce the amplitude of the feedback voltage $V_{sense}$. For example, the voltage conditioner 124 can include one or more additional voltage dividers to reduce the range of the feedback voltage to a range that is suitable for operating a power transistor within the power supply 118. For example, the voltage conditioner 124 can reduce the feedback voltage $V_{sense}$ by 90% so that the voltage conditioner 124 transmits a voltage signal to the power supply 118 that is 10% of the feedback voltage $V_{sense}$ to enable the power supply 118 to selectively decrease the quantity of charged particles 121 supplied to the flame 104. In alternative implementations, the values of the first resistor 126 and the second resistor 128 are set or selected so that the feedback voltage $V_{sense}$ is within a range that is appropriate for use by the power supply 118. The voltage conditioner 124 may be configured as circuitry within the power supply 118. The voltage conditioner 124 may further include a filter to provide time averaging of $V_{sense}$, such as to inhibit oscillation of flame controller 108, or a derivative circuit to speed up response time of the flame controller 108. Optionally, the voltage conditioner 124 may be omitted.

The electrodynamic flame control system 100 can control the distance D between the flame holder 106 and the bottom 116 of the flame 104. The electrodynamic flame control system 100 uses the flame controller 108 to monitor the flame holder voltage $V_{fh}$ and to adjust the flame voltage $V_{flame}$ so that the flame holder current $I_{fh}$ through the voltage divider 122 maintains a flame holder voltage $V_{fh}$ that attracts, draws, and/or positions the flame 104 onto the flame holder 106, according to various embodiments.

Figure 2:
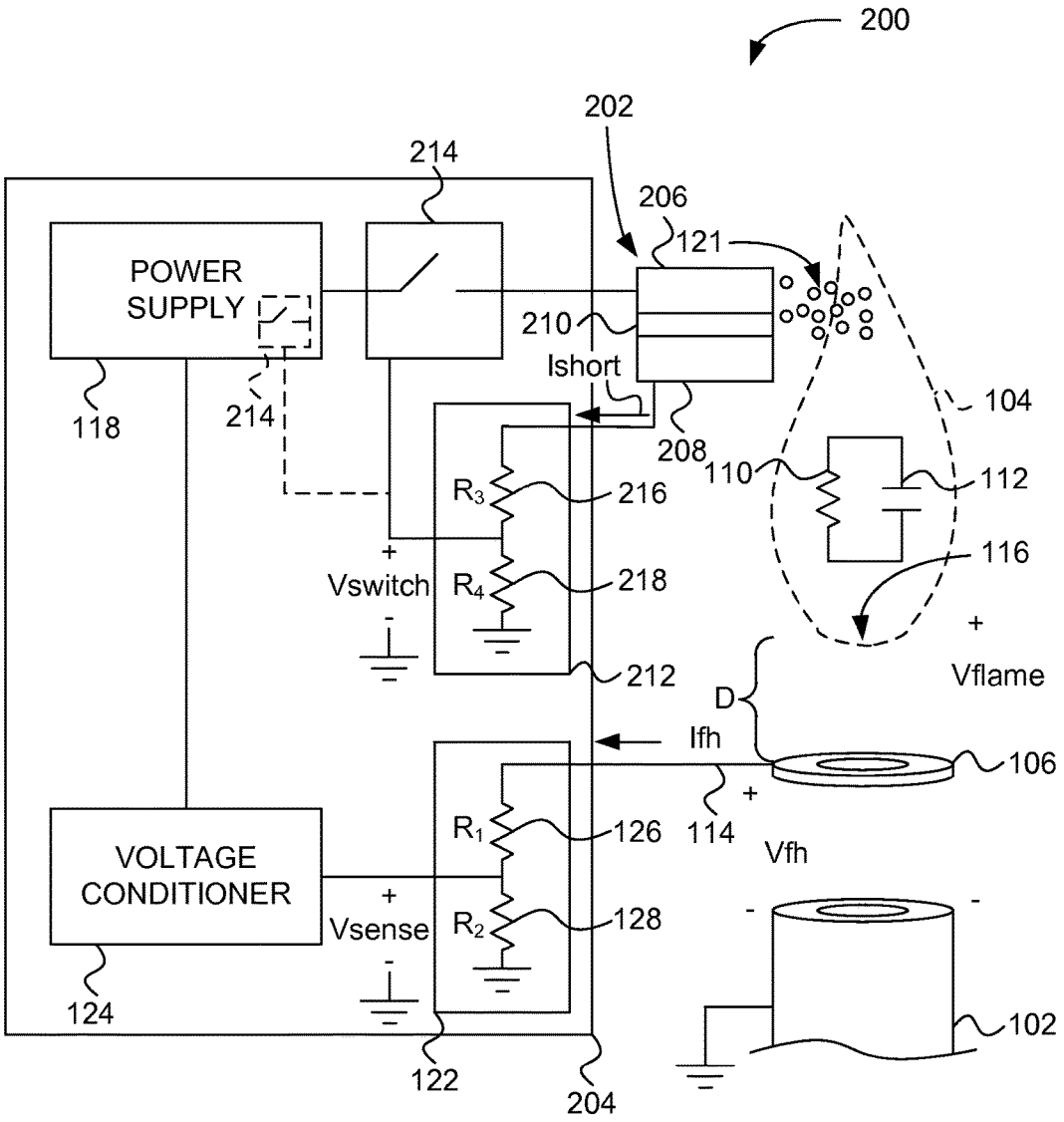
FIG. 2 a circuit diagram of a system for protecting power supply, according to an embodiment.

FIG. 2 illustrates an electrodynamic flame control system 200 for monitoring contact between an electrode and a flame to reduce potential damage to a power supply that may be caused by inadvertent contact between the electrode and the flame, according to one embodiment. The electrodynamic flame control system 200 can include an electrode 202 and a flame controller 204.

The electrode 202 can enable the flame controller 204 to determine when the flame 104 makes contact with or draws near to the electrode 202. The electrode 202 can include a first electrode 206 and a second electrode 208 that is separated from the first electrode 206 by an insulator 210. The first electrode 206 can be similar to the electrode 120 of FIG. 1 and can include a needle, a ring, a blade, a plate, or other suitable charged particle generating electrode configurations. Additionally or alternatively, the first electrode 206 can be a large-radius or flat electrode that does not eject charged particles, but rather interacts with the flame 104 by providing an electric field. The second electrode 208 is applied to, adhered to, affixed to, carried by, and/or coupled to the first electrode 206 in order to direct current back to the flame controller 204 when the flame 104 comes into close proximity with the electrode 202.

The flame controller 204 may apply a voltage, e.g., in the range of 30-50 kV, to the first electrode 206 in order to supply the charged particles 121 to the flame 104. The flame controller 204 may be configured to supply enough voltage to the first electrode 206 to enable charged particle generation without creating an electrical short between the first electrode 206 and the flame 104, e.g., by exceeding a breakdown voltage for the air between the first electrode 206 and the flame 104.

In one implementation, the electrode 202 can enable the flame controller 204 to determine when the flame 104 comes in relatively close proximity (e.g., less than between 0.25-0.75 inches) to the electrode 202 by detecting a reduced-resistance coupling between the first electrode 206 and the second electrode 208. The second electrode 208 is separated from the first electrode 206 by the insulator 210. When the flame comes into contact with or close proximity to the electrode 202, more current may flow between the first electrode 206 and the second electrode 208, than when the flame 104 is not in close proximity to the electrode 202. In terms of resistivity, air has an approximate resistivity of $1\text{-}3\times10^{16}$ Ωm, whereas the flame 104 has an approximate resistivity of $25.4\times10^{4}$ Ωm (or $10\times10^{6}$ Ωin). In other words a flame having a height of an inch can have a resistance of approximately 10 MΩ. The flame controller 204 can be configured to decouple the power supply 118 from the electrode 202 in response to detecting a change in current flowing between the first electrode 206 and the second electrode 208.

In another implementation, the electrode 202 can enable the flame controller 204 to determine when the flame 104 comes into relatively close proximity (e.g., less than 1 cm) to the electrode 202 by measuring or detecting charge at the second electrode 208. For example, if the first electrode 206 charges the flame 104 to a flame voltage $V_{flame}$ that is approximately 30-50 kV, then the second electrode 208 will become exposed the flame voltage $V_{flame}$ as the flame 104 makes contact with or comes into relatively close proximity to the second electrode 208. The flame controller 204 can be configured to decouple the power supply 118 from the electrode 202, in response to detecting a voltage at the second electrode 208 that exceeds a pre-determined threshold, e.g., 10 kV.

The flame controller 204 can include a voltage divider 212 and a switch 214 for selectively decoupling the power supply 118 from the electrode 202. The voltage divider 212 may be operably coupled between the second electrode 208 and the switch 214 in order to operate the switch 214 when a voltage at the second electrode 208 exceeds a predetermined threshold. The voltage divider 212 can be configured to provide a switch voltage $V_{switch}$ that is sufficient to operate a gate, flame holder, or other control electrode of the switch 214, without damaging the switch 214. The voltage divider 212 can include a first resistor ("R3") 216 and a second resistor ("R4") 218 for detecting the flame voltage $V_{flame}$ and for converting the flame voltage $V_{flame}$ into the switch voltage $V_{switch}$ that may be suitable for operating the switch 214.

For example, the flame controller 204 can be configured to decouple the power supply 118 from the electrode 202 when the second electrode 208 detects a voltage that is greater than or equal to 10 kV. The first resistor 216 can be chosen to have a resistance of 1 MΩ and second resistor 218 can be chosen to have a resistance of 1 kΩ, so the switch voltage $V_{switch}$ is set to 10 V when 10 kV is detected at the second electrode 208. According to one embodiment, the switch 214 can be configured to decouple the power supply 118 from the electrode 202 when the switch voltage is $V_{switch}$ is greater than or equal to a predetermined threshold, e.g., 10 V.

According to another embodiment, the switch 214 can be optionally disposed within the power supply 118 to deenergize the power supply 118 when the second electrode 208 detects a voltage that is greater than or equal to a predetermined threshold. For example, the switch 214 can be configured to decouple an AC power source from the power supply 118, when the switch voltage $V_{switch}$ is greater than or equal to a threshold voltage, e.g., 10 V. As another example, the switch 214 can be configured to decouple one or more step-up transformers, rectifiers, DC/AC converters, and AC/DC inverters from one or more other step-up transformers, rectifiers, DC/AC converters, and AC/DC inverters in order to deenergize the power supply 118.

The electrode 202 may be implemented using a variety of techniques. The second electrode 208 can be an electrode grid that is adhered to, applied to, carried by, or otherwise coupled to the first electrode 206. The second electrode 208 can be coupled to the insulator 210 such that the second electrode 208 is positioned closer to the flame 104 than the first electrode 206. By positioning the second electrode 208 closer to a flame 104, the second electrode 208 can be configured to detect the flame voltage $V_{flame}$ before the flame 104 physically makes contact with the first electrode 206, according to one embodiment.

Figure 3:
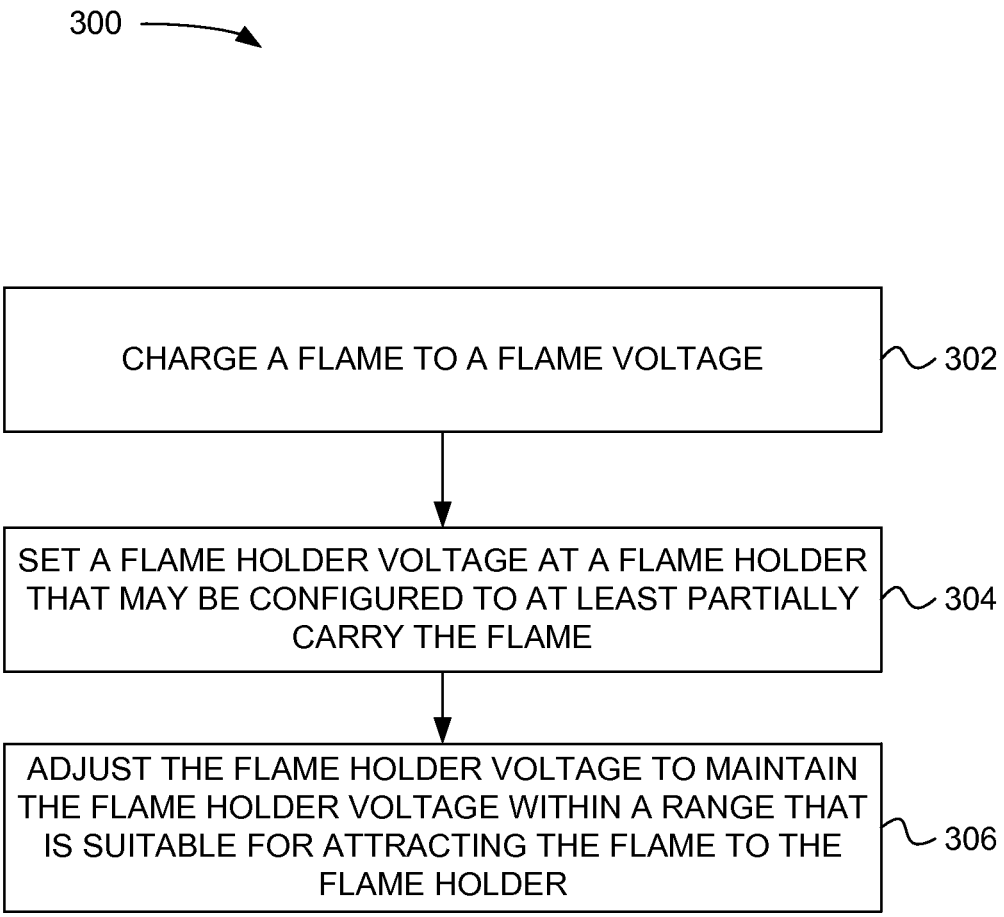
FIG. 3 a flow diagram of a method for electrically controlling a position of a combustion reaction, according to an embodiment.

FIG. 3 illustrates a method 300 for positioning a flame over a flame holder, according to one embodiment.

At block 302, a flame controller may charge a flame to a flame voltage. The flame controller may use an electrode as an ionizer to supply positive charged particles, negative charged particles, or positive and negative charged particles to the flame to charge the flame to a predetermined flame voltage or to a predetermined range of flame voltages. The flame controller may use one or more power supplies to charge or excite the electrode to voltages in excess of, for example, 4 kV to cause the electrode to generate charged particles. The electrode may be initially positioned to a pre-determined distance, e.g., 1-10 inches or 1-2 inches, from the flame.

At block 304, the flame controller may set a flame holder voltage at a flame holder that may be configured to at least partially carry the flame. The flame controller may set the flame holder voltage by receiving current from the charged flame through the flame holder, and by applying the received current to a voltage divider. The flame holder may be operably coupled to the voltage divider through a conductor to supply current from the flame to the flame controller.

At block 306, the flame controller may adjust the flame holder voltage to maintain the flame holder voltage within a range that is suitable for attracting the flame to the flame holder. For example, the flame controller may be configured to set the flame holder voltage so that the flame is drawn to, attracted to, displaced towards the flame holder. The flame may be drawn to, attracted to, or displaced towards the flame holder when the flame holder voltage is significantly less than the flame voltage, e.g., 30-40 times less. The flame controller may be configured to maintain the flame holder voltage within a lower and upper range of thresholds, e.g., 1-3 kV. If the flame controller determines that the flame holder voltage is below a lower threshold, the flame controller may be configured to increase the flame voltage by supplying additional charged particles to the flame. If the flame controller determines that the flame holder voltage is above an upper threshold, the flame controller may be configured to decrease the flame voltage by ceasing to supply charged particles to the flame or by supplying fewer charged particles to the flame. The flame controller may determine the flame holder voltage by monitoring one or more resistances of a voltage divider. For example, a power supply within the flame controller may be operably or communicatively coupled to the voltage divider to receive a voltage that is less than and proportional to the flame holder voltage.

Figure 4:
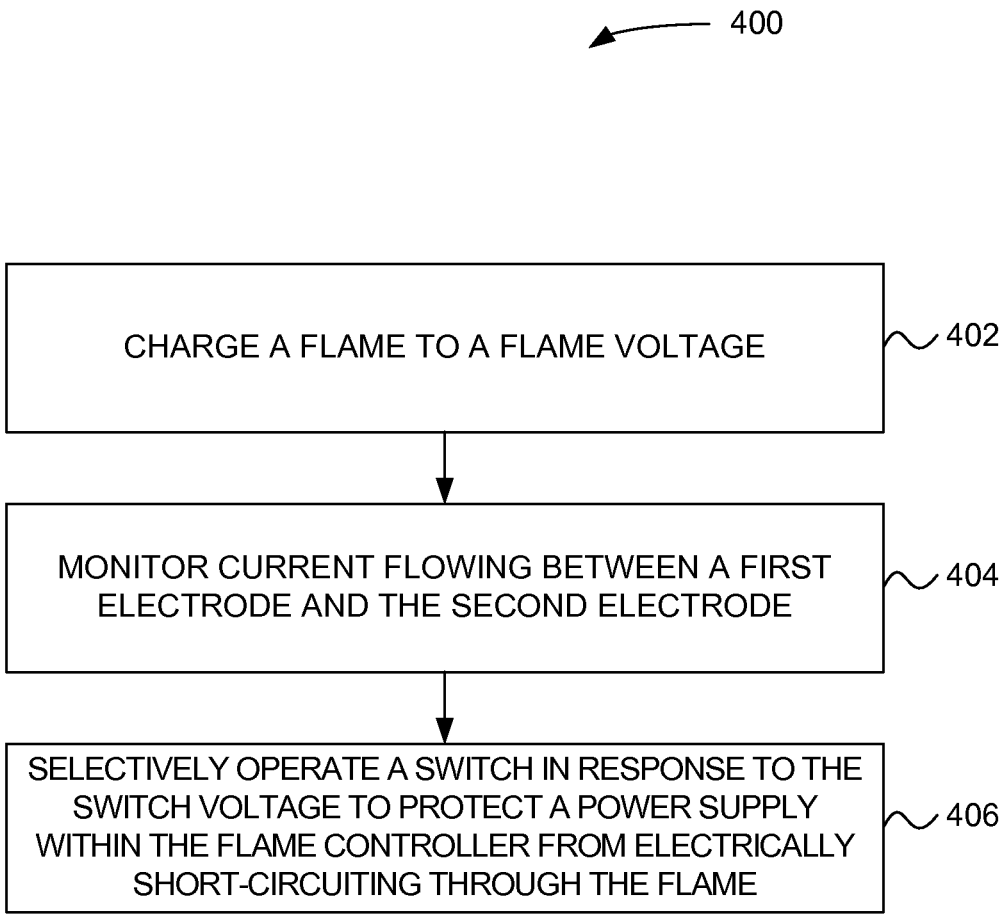
FIG. 4 a flow diagram of a method for protecting a power supply, according to an embodiment.

FIG. 4 illustrates a method 400 for protecting a power supply from electrically short-circuiting through a flame, according to one embodiment.

At block 402, a flame controller may charge a flame to a flame voltage. The flame controller may charge the flame to a flame voltage within the range of approximately 1-150 kV or 30-50 kV, according to various implementations. The flame controller may include an ionizer having multiple electrical components. The ionizer may include a first electrode, a second electrode, and an insulator between the first and second electrodes. The flame controller may use the first electrode as an ionizer to supply positive charged particles, negative charged particles, or positive and negative charged particles to the flame to charge the flame to a predetermined flame voltage. The ionizer may be initially positioned to a pre-determined distance, e.g., 1-2 inches, from the flame. The flame controller may use a power supply to charge or excite the first electrode to voltages in excess of, for example, 4 kV to cause the first electrode to generate charged particles.

At block 404, the flame controller monitors current flowing between the first electrode and the second electrode. Because the first electrode and the second electrode are electrically separated by an insulator and by air, negligible amounts of current may flow between the first electrode and the second electrode while the flame does not affect the resistance between the first and second electrodes. When the flame approaches, touches, contacts, nearly contacts, or comes into close proximity to the ionizer (e.g., the first and second electrodes), the resistance between the first electrode and the second electrode decreases, and an increased quantity or a detectable quantity of current flows between the first electrode and the second electrode. As an oversimplified example, if the resistance of the flame is 10 MΩ and the potential at the first electrode is 40 kV, then when the flame comes into contact with the electrodes, a short current $I_{short}$, e.g., 4 mA, may flow from the first electrode to the second electrode. The flame controller may then apply the current from the second electrode to one or more resistors, e.g., a voltage divider, to generate a sense voltage.

In another implementation, the flame controller monitors the flame voltage to generate the sense voltage. If, for example, the flame is charged to 40 kV, then the second electrode becomes charged to the same potential as the flame when the flame comes into contact with the second electrode. The potential of the second electrode may be applied to a voltage divider to generate a sense voltage that is in a range that is suitable for operating a gate, flame holder, or other controlling electrode of a switch.

At block 406, the flame controller may selectively operate a switch in response to the switch voltage to protect a power supply within the flame controller from electrically short-circuiting through the flame. The switch voltage may be applied to a control electrode of a switch to create a high-impedance connection between the ionizer and the power supply. Alternatively, the switch voltage may be applied to a control electrode of a switch disposed within the power supply to de-energize the power supply. The switch may be configured to maintain a low-impedance path between the operating terminals of the switch, until the switch voltage exceeds a pre-determined threshold, e.g., 10 V.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for electrically controlling a combustion reaction, comprising:

a burner configured to support a combustion reaction, wherein the combustion reaction is characterized by a resistance and a capacitance;

a flame holder positioned proximate to the burner to at least partially carry the combustion reaction, wherein the flame holder is electrically conductive; and a flame controller operable to electrically charge the combustion reaction and to apply a flame holder voltage to the flame holder to attract the combustion reaction to the flame holder, wherein the flame controller includes:

an electrode positioned proximate to the flame holder to enable the electrode to supply the combustion reaction with charged particles;

a power supply operably coupled to the electrode to excite the electrode to generate the charged particles; and a voltage divider operably coupled to the flame holder to provide the flame holder voltage;

wherein the voltage divider includes a first resistor electrically connected to the flame holder and a second resistor electrically connected between the first resistor and a ground reference; and wherein a sense voltage is a voltage across the second resistor, wherein the power supply selectively excites the electrode based on the sense voltage to maintain the flame holder voltage above a predetermined threshold.

2. The system of claim 1, wherein the capacitance is between 3-50 picofarads.

3. The system of claim 1, wherein the flame holder includes an aperture to enable fuel to pass through the flame holder.

4. The system of claim 3, wherein the flame holder includes a shape of a crescent, a square, a cross, or a ring.

5. The system of claim 3, wherein the flame holder is suspended above the burner.

6. The system of claim 1, wherein the flame holder voltage is at least 1 kV.

7. The system of claim 1, wherein the voltage divider generates a sense voltage based on the flame holder voltage.

8. The system of claim 7, wherein power supply selectively excites the electrode at least partially based on the sense voltage.

9. The system of claim 8, wherein the power supply is configured to stop exciting the electrode if the sense voltage exceeds a threshold.

10. The system of claim 1, wherein the first resistor is at least 10 times more resistive than the second resistor.

* * * * *